US010072512B2

(12) United States Patent
Beers et al.

(10) Patent No.: US 10,072,512 B2
(45) Date of Patent: Sep. 11, 2018

(54) TURBINE NOZZLE AND SHROUD

(71) Applicant: Hamilton Sundstrand Corporation, Windsor Locks, CT (US)

(72) Inventors: Craig M. Beers, Wethersfield, CT (US); Christopher McAuliffe, Windsor, CT (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 1332 days.

(21) Appl. No.: 13/869,045

(22) Filed: Apr. 24, 2013

(65) Prior Publication Data

US 2014/0321978 A1 Oct. 30, 2014

(51) Int. Cl.

| | |
|---|---|
| ***F01D 9/04*** | (2006.01) |
| ***F01D 9/02*** | (2006.01) |
| ***F01D 5/00*** | (2006.01) |
| ***F01D 5/28*** | (2006.01) |
| ***F01D 5/14*** | (2006.01) |

(52) U.S. Cl.

CPC ..... *F01D 9/02* (2013.01); *F01D 5/005* (2013.01); *F01D 5/147* (2013.01); *F01D 5/288* (2013.01); *F01D 9/041* (2013.01); *F01D 9/045* (2013.01); *F01D 9/048* (2013.01); *F05D 2230/80* (2013.01); *F05D 2230/90* (2013.01); *F05D 2240/128* (2013.01); *F05D 2260/95* (2013.01); *Y10T 29/4932* (2015.01)

(58) Field of Classification Search

CPC ..... F01D 5/005; F01D 5/141; F01D 5/147; F01D 5/228; F01D 9/041; F01D 9/048; F01D 9/045; F01D 9/288; F01D 17/141; F05D 2230/80; F05D 2230/90; F05D 2240/128; F05D 2260/95; F02C 1/02

See application file for complete search history.

(56) References Cited

U.S. PATENT DOCUMENTS

| | | | | |
|---|---|---|---|---|
| 3,972,644 A | | 8/1976 | Johnson | |
| 4,726,101 A | | 2/1988 | Draghi et al. | |
| 4,798,515 A | | 1/1989 | Hsia et al. | |
| 5,142,778 A | * | 9/1992 | Smolinski | B23K 26/00 219/121.66 |
| 5,249,934 A | * | 10/1993 | Merritt | F04D 29/5853 417/406 |
| 5,299,909 A | | 4/1994 | Wulf | |
| 5,309,735 A | * | 5/1994 | Maher, Jr. | B64D 13/00 417/406 |
| 5,311,749 A | * | 5/1994 | McAuliffe | F02C 3/32 415/12 |

(Continued)

FOREIGN PATENT DOCUMENTS

CN 103016069 A 4/2013

*Primary Examiner* — Ninh H Nguyen

(74) *Attorney, Agent, or Firm* — Carlson, Gaskey & Olds, P.C.

(57) ABSTRACT

A nozzle and shroud for use in an air cycle machine has a plate and a shroud curving in a first axial direction about a center axis of the shroud relative to the plate. A plurality of vanes extends in a second axial direction away from the plate. The plurality of vanes extends for a height away from the plate and a width defined as the closest distance between two adjacent vanes, with a ratio of the height to the width being between 1.7377 and 2.1612. An air cycle machine and a method of repair are also disclosed.

6 Claims, 2 Drawing Sheets

(56) References Cited

U.S. PATENT DOCUMENTS

| | | | | |
|---|---|---|---|---|
| 5,460,003 | A * | 10/1995 | Nenov | F01D 9/045 415/186 |
| 5,522,134 | A * | 6/1996 | Rowe | B23P 6/005 29/402.08 |
| 5,630,700 | A | 5/1997 | Olsen et al. | |
| 6,109,867 | A | 8/2000 | Portefaix | |
| 6,398,489 | B1 | 6/2002 | Burdgick et al. | |
| 6,789,315 | B2 * | 9/2004 | Marques | B23P 6/002 228/119 |
| 6,942,183 | B2 | 9/2005 | Zywiak | |
| 7,322,202 | B2 | 1/2008 | Zywiak et al. | |
| 7,779,644 | B2 | 8/2010 | Decrissantis et al. | |
| 8,016,551 | B2 * | 9/2011 | Lin | F01D 9/045 415/163 |
| 8,113,787 | B2 * | 2/2012 | Barril | F01D 5/288 416/224 |
| 8,347,647 | B2 | 1/2013 | McAuliffe | |
| 2007/0134105 | A1 | 6/2007 | Beers et al. | |
| 2012/0156028 | A1 * | 6/2012 | Colson | F01D 25/28 415/208.2 |

* cited by examiner

TURBINE NOZZLE AND SHROUD

BACKGROUND

This application relates to a turbine nozzle and shroud for use in an air cycle machine.

Air cycle machines are known and, typically, include one or more turbines which receive a compressed air source, and are driven to rotate. The turbines, in turn, rotate a compressor rotor. Air is conditioned by the air cycle machine and moved for use in an aircraft cabin air conditioning and temperature control system.

The turbines are typically provided with a nozzle and shroud which controls the flow of air upstream and downstream of a turbine rotor.

SUMMARY

A nozzle and shroud for use in an air cycle machine has a plate and a shroud curving in a first axial direction about a center axis of the shroud relative to the plate. A plurality of vanes extends in a second axial direction away from the plate. The plurality of vanes extends for a height away from the plate and a width defined as the closest distance between two adjacent vanes, with a ratio of the height to the width being between 1.7377 and 2.1612. An air cycle machine and a method of repair are also disclosed.

These and other features may be best understood from the following drawings and specification.

DETAILED DESCRIPTION

Figure 1:
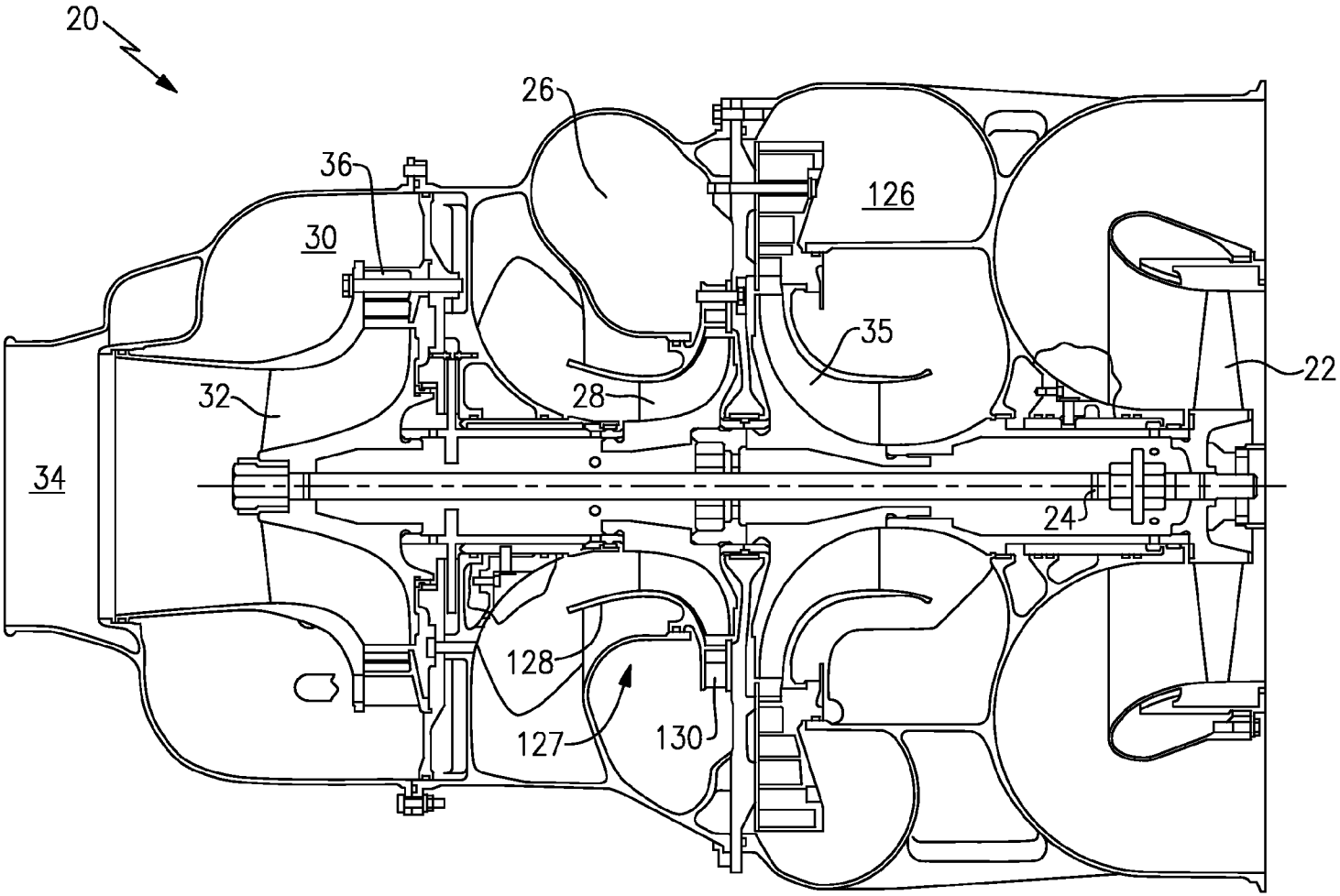
FIG. 1 shows an air cycle machine.

An air cycle machine 20 is illustrated in FIG. 1 having a fan 22 being driven by a shaft 24. As known, a compressor 35 receives compressed air from a compressed air source at an inlet 126 and further compresses the air. The air passes downstream into a first turbine inlet 26 which drives a first stage turbine rotor 128. The air then passes across a second stage turbine rotor 32, and through an outlet 34. The air may be used in an aircraft cabin and as part of a cabin air conditioning and temperature control system.

A turbine nozzle 36 is associated with the second stage turbine rotor and serves to direct airflow from the inlet to the turbine rotor 32.

A first stage shroud and nozzle 127 includes a shroud 128 downstream of the rotor 28 and a nozzle 130 upstream of the rotor 28.

Figure 2B:
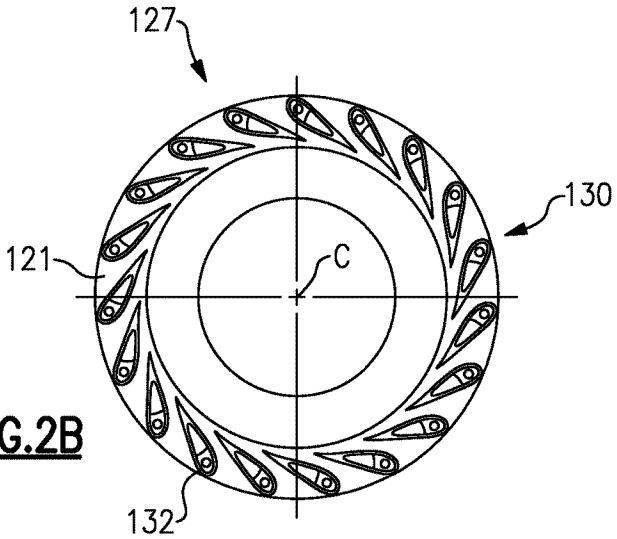
FIG. 2B is a view of the turbine nozzle portion.
Figure 2D:
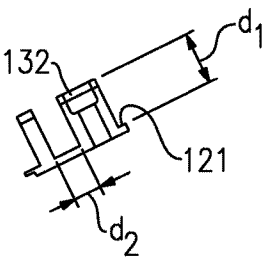
FIG. 2D is a sectional line taken along line D-D of FIG. 2C.
Figure 2A:
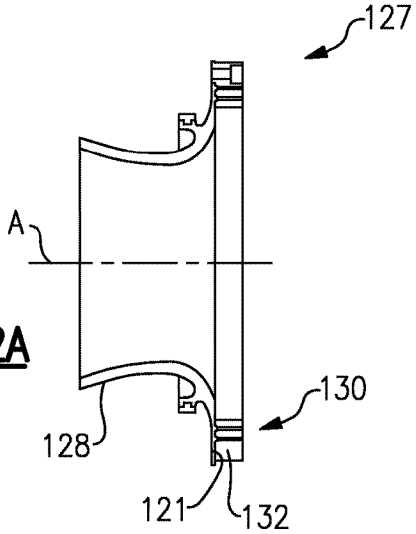
FIG. 2A is a cross-sectional view through a turbine nozzle and shroud for a first stage turbine.

FIG. 2A shows details of the nozzle and shroud 127. As shown, a shroud portion 128 curves forwardly away from a plate 121 along a center axis A. The plate 121 carries a plurality of vanes 132, which can also be seen in FIG. 2B. In one embodiment, there were 19 vanes spaced circumferentially about center axis C of the nozzle and shroud 127.

Figure 2C:
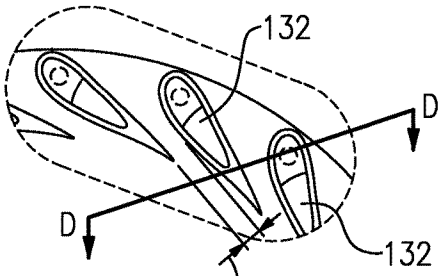
FIG. 2C shows details of vanes.

As shown in FIG. 2C, a cross-sectional view D-D is taken between two adjacent vanes 132. As shown in FIG. 2D, a height or distance the vane 132 extends away from the plate 121 is defined at $d_1$. A distance $d_2$ may be defined as a passage width and is the closest distance between two adjacent vanes 132, measured tangent, or parallel to the sides of the airfoil surfaces of vane 122.

In one embodiment, the height $d_1$ was 0.560 inch (1.42 centimeters) and the width $d_2$ was 0.289 inch (0.734 centimeters). This results in a total flow area between all 19 of the vanes of 3.075 square inches (7.8105 centimeters).

In embodiments, a ratio of a height $d_1$ to the width $d_2$ was between 1.7377 and 2.1612. In embodiments, a total nozzle flow area was between 2.7491 and 3.4191 square inches).

The nozzle and shroud 127 has a tungsten carbide erosion coating. The nozzle and shroud 127 is formed of a base of aluminium and then provided with a tungsten carbide erosion coating. Preferably, a high velocity oxy fuel coating technique is provided utilizing continuous burning.

A method of repairing air cycle machine 20 includes the steps of removing a nozzle and shroud combination 127 from a location adjacent a first stage turbine rotor 28. A replacement nozzle and shroud combination 127 is then mounted adjacent rotor 28.

Details of the nozzle 36 are disclosed and claimed in co-pending application Ser. No. 13/869,048, entitled Turbine Nozzle for Air Cycle Machine, and filed on even date herewith.

Although an embodiment of this invention has been disclosed, a worker of ordinary skill in this art would recognize that certain modifications would come within the scope of this disclosure. For that reason, the following claims should be studied to determine the true scope and content of this disclosure.

The invention claimed is:

1. A nozzle and shroud for use in an air cycle machine comprising:

a plate and a shroud curving in a first axial direction about a center axis of said shroud relative to said plate;

a plurality of vanes extending in a second axial direction away from said plate, with said plurality of vanes extending for a height away from said plate and a width being defined as the closest distance between two adjacent vanes, with a ratio of said height to said width being between 1.7377 and 2.1612;

wherein there are 19 circumferentially spaced ones of said vanes; and wherein a total flow area is defined between all 19 of said vanes and said total flow area being between 2.7491 and 3.4191 square inches (17.736-22.058 square centmeters).

2. The nozzle and shroud as set forth in claim 1, wherein said plate and said shroud are formed of a base aluminum material provided with a tungsten carbide erosion coating.

3. An air cycle machine comprising:

a first stage turbine rotor and a second stage turbine rotor, said first and second stage turbine rotors being configured to drive a shaft, and a compressor rotor driven by said shaft, and a fan rotor driven by said shaft;

a shroud and nozzle combination provided adjacent said first stage turbine rotor with said nozzle being at a location upstream of said first stage turbine rotor, and said shroud curving to a location downstream of said first stage turbine rotor and said shroud and nozzle including a plate and said shroud curving in a first axial direction about a center axis of said shroud relative to said plate;

a plurality of vanes extending in a second axial direction away from said plate, with said plurality of vanes extending for a height away from said plate and a width being defined as the closest distance between two adjacent vanes, with a ratio of said height to said width being between 1.7377 and 2.1612;

wherein there are 19 circumferentially spaced ones of said vanes; and wherein a total flow area is defined between all 19 of said vanes and said total flow area being between 2.7491 and 3.4191 square inches (17.736-22.058 square centmeters).

4. The air cycle machine as set forth in claim 3, wherein said plate and said shroud are formed of a base aluminum material provided with a tungsten carbide erosion coating.

5. A method of repairing an air cycle machine comprising the steps of:

(a) removing a nozzle and shroud combination from a location adjacent a first stage turbine rotor in an air cycle machine, and replacing said removed shroud and nozzle combination with a replacement shroud and nozzle combination;

(b) the replacement nozzle and shroud combination including a plate and a shroud curving in a first axial direction about a center axis of said shroud relative to said plate, and a plurality of vanes extending in a second axial direction away from said plate, with said plurality of vanes extending for a height away from said plate and a width being defined as the closest distance between two adjacent vanes, with a ratio of said height to said width being between 1.7377 and 2.1612;

wherein there are 19 circumferentially spaced ones of said vanes; and wherein a total flow area is defined between all 19 of said vanes and said total flow area being between 2.7491 and 3.4191 square inches (17.736-22.058 square centmeters).

6. The method as set forth in claim 5, wherein said plate and said shroud are formed of a base aluminum material provided with a tungsten carbide erosion coating.

* * * * *